US006094185A

United States Patent [19]

Shirriff

[11] Patent Number: 6,094,185

[45] **Date of Patent: *Jul. 25, 2000**

[54] APPARATUS AND METHOD FOR AUTOMATICALLY ADJUSTING COMPUTER DISPLAY PARAMETERS IN RESPONSE TO AMBIENT LIGHT AND USER PREFERENCES

[75] Inventor: Kenneth W. Shirriff, Mountain View, Calif.

[73] Assignee: Sun Microsystems, Inc., Mountain View, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/852,416

[22] Filed: May 7, 1997

Related U.S. Application Data

[63] Continuation of application No. 08/498,789, Jul. 5, 1995, abandoned.

[51] Int. Cl.[7] ..... G09G 3/36

[52] U.S. Cl. ..... 345/102; 345/147

[58] Field of Search ..... 345/12, 22, 55, 345/63, 77, 87, 88, 89, 147, 112, 102; 348/602, 603

[56] References Cited

U.S. PATENT DOCUMENTS

| | | | |
|---|---|---|---|
| 3,200,193 | 8/1965 | Biggs et al. | 348/602 |
| 4,386,345 | 5/1983 | Narveson et al. | 345/22 |
| 4,805,010 | 2/1989 | Shroyer et al. | 348/366 |
| 5,270,818 | 12/1993 | Ottenstein | 348/602 |
| 5,442,375 | 8/1995 | Wojaczynski et al. | 345/147 |
| 5,617,112 | 4/1997 | Yoshida et al. | 345/102 |

*Primary Examiner*—Chanh Nguyen
*Attorney, Agent, or Firm*—William S. Galliani; Pennie & Edmonds LLP

[57] ABSTRACT

An apparatus to automatically adjust, in accordance with a set of user preferences, a computer display parameter, such as brightness or contrast, in response to ambient light conditions is described. The apparatus includes an ambient light sensor to obtain an ambient light signal. A mapping mechanism, connected to the ambient light sensor, maps the ambient light signal to a user preference value in a user preference table. Computer display control circuitry, connected to the mapping mechanism, then adjusts the selected computer display parameter of the computer display in response to the user preference value. A preferable embodiment of the invention includes colored light sensors that produce colored ambient light signals. The colored ambient light signals are mapped into colored preference tables. By adjusting the values in the colored preference tables, the image appearing on the computer display can be matched to a replica of the image printed on paper.

21 Claims, 3 Drawing Sheets

APPARATUS AND METHOD FOR AUTOMATICALLY ADJUSTING COMPUTER DISPLAY PARAMETERS IN RESPONSE TO AMBIENT LIGHT AND USER PREFERENCES

This is a continuation of application Ser. No. 08/498,789 filed Jul. 5, 1995, now abandoned.

BRIEF DESCRIPTION OF THE INVENTION

This invention relates generally to computer displays, such as cathode ray tube (CRT) monitors and liquid crystal display (LCD) screens. More particularly, this invention relates to an apparatus and method that continuously responds to ambient light conditions to adjust, in accordance with specified user preferences, computer display parameters, such as brightness and contrast.

BACKGROUND OF THE INVENTION

One technique to communicate the data output of a computer is to present it on a computer display. The compute:. display may be in the form of a cathode ray tube (CRT) monitor or liquid crystal display (LCD) flat panel screen. The visual clarity of the information on a computer display is a function of computer display parameters, such as brightness and contrast. Computer display parameters are affected by ambient light. Some color televisions use a light sensor to linearly increase the brightness of a color television picture for each linear increase in ambient light.

Computer users have a wide variety of preferences regarding computer display parameters. It would be highly desirable to accommodate each user's computer display preferences while simultaneously accounting for ambient light conditions. That is, it would be highly desirable to automatically control computer display parameters in response to a combination of ambient light conditions and a set of user-specified preferences.

The clarity of information on a computer display is especially important in the context of computers used for desktop publishing. In such applications, it is desirable to manipulate the color of an image appearing on a computer display and then have the image on the computer display accurately reproduced on paper. Unfortunately, this is a difficult undertaking. A computer display generates color additively, in contrast to printed media, which reflects light and thereby generates light subtractively. Consequently, an image on a computer display does not respond to ambient light in the same way as an image on paper. Thus, color modifications made to an image appearing on a computer display will not directly translate into the same color modifications on the image appearing on paper. It would be highly desirable to provide a mechanism to tailor individual additive color (red, green, and blue) preference values used on a computer display. The color preference values could then be used to accurately represent how an image appearing on a computer display will ultimately appear on paper.

SUMMARY OF THE INVENTION

The invention is an apparatus to automatically adjust, in accordance with a set of user preferences, a computer display parameter, such as brightness or contrast, in response to ambient light conditions. The apparatus includes an ambient light sensor to obtain an ambient light signal. A mapping mechanism, connected to the ambient light sensor, maps the ambient light signal to a user preference value in a user preference table. Computer display control circuitry, connected to the mapping mechanism, then adjusts the selected computer display parameter of the computer display in response to the user preference value. A preferable embodiment of the invention includes colored light sensors that produce colored ambient light signals. The colored ambient light signals are mapped into colored preference tables.

The method of the invention includes the steps of sensing an ambient light signal, mapping the ambient light signal to a user preference value in a user preference table, and adjusting the computer display parameter of the computer display in response to the user preference value.

The invention provides for a computer display that is highly customized for an individual's preferences. The invention's preference tables provide a variety of display parameter options, such as constantly maintaining display parameters despite changes in ambient light, or changing display parameters in response to changes in ambient light. The use of colored preference tables is highly advantageous in desktop publishing applications. The colored preference tables allow a user to accurately reproduce printed image color tones on a computer display.

BRIEF DESCRIPTION OF THE DRAWINGS

For a better understanding of the nature and objects of the invention, reference should be made to the following detailed description taken in conjunction with the accompanying drawings, in which.

Like reference numerals refer to corresponding parts throughout the several views of the drawings.

DETAILED DESCRIPTION OF THE INVENTION

Figure 1:
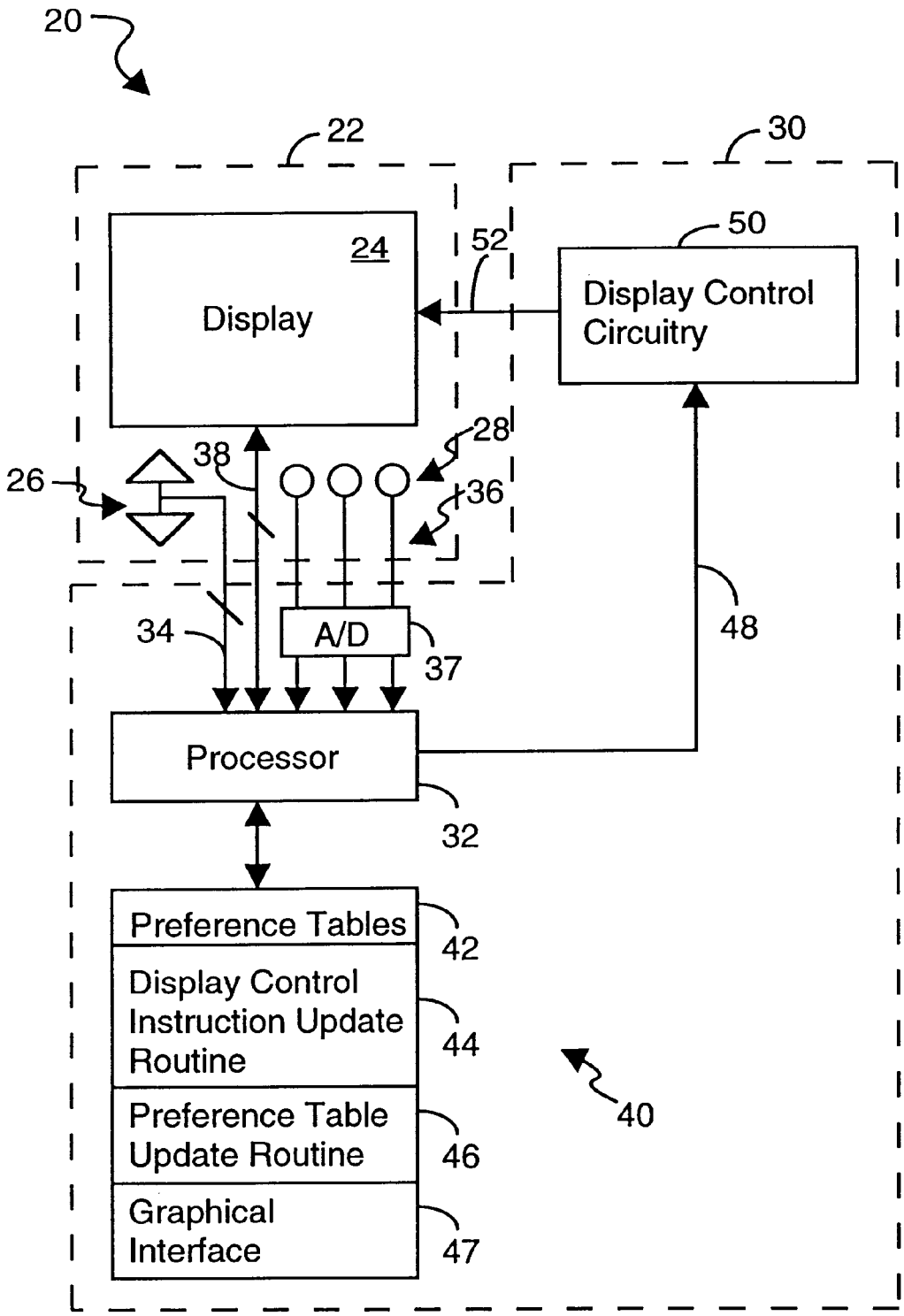
FIG. 1 illustrates one embodiment of an apparatus, in accordance with the invention, for automatically adjusting computer display parameters in response to ambient light conditions and user preferences.

FIG. 1 illustrates one embodiment of an apparatus 20, in accordance with the invention, for automatically adjusting computer display parameters in response to ambient light conditions and user preferences. The apparatus 20 includes an exterior portion 22, which includes a standard computer display 24, such as a cathode ray tube (CRT) monitor or liquid crystal display (LCD) screen. The exterior portion 22 also includes hardware preference interface devices 26, which may be implemented as analog knobs or digital input keys to specify computer display parameters, such as brightness and contrast. The exterior portion 22 of the apparatus 20 also includes one or more ambient light sensors 28. In a preferable embodiment, one sensor is used to measure light intensity and produce an ambient light intensity signal, another sensor is used to measure red light and produce a red light ambient signal, another sensor is used to measure green light and produce a green light ambient signal, and another sensor is used to measure blue light and produce a blue light ambient signal.

The apparatus 20 also includes an interior portion 30 which houses the electronic components associated with the invention. The interior portion 30 may be in the housing (not shown) for the display 24 or it may be in the housing (not shown) for the computer that uses display 24. The interior portion 30 includes a processor 32. If the interior portion 30 is in the display housing, a separate processor may be used; if the interior portion 30 is in the computer housing, the central processing unit of the computer may be used.

The processor 32 receives signals from the exterior portion 22. A hardware preference bus 34 connects the output of the hardware preference interface devices 26 to the processor 32. Light sensor lines 36 are also connected to the processor 32. The light sensor lines 36 are shown as being connected to an analog-to-digital converter 37. The light sensors 28 and hardware preference interface devices 26 may be implemented as either analog or digital devices, an analog-to-digital converter 37 will be required for analog implementations. The processor 32 also receives input from a display data bus 38, which is used to relay preference values obtained from a graphical interface appearing on the computer display 24, as will be discussed below.

The processor 32 processes the input signals from the exterior portion 22 in accordance with a set of program instructions stored in a computer readable memory 40. In the disclosed embodiment, memory 40 stores preference tables 42, a display control instruction update routine 44, a preference table update routine 46, and an optional graphical interface 47. As will be described in detail below, the program instructions in the memory 40 are used to map an ambient light signal from a sensor 28 to a user preference value in a user preference table 42. The user preference value or a corresponding signal may be conveyed over processor output line 48 to display control circuitry 50. Display control circuitry 50 may be standard circuitry used to control a computer display through a set of display control instruction signals passed over display control output bus 52.

The combined operation of a display 24, processor 32, memory 40, and display control circuitry 50 is known in the art. The present invention is directed toward coupling these features with one or more light sensors 28 which produce one or more ambient light signals. The invention is further directed toward processing those ambient light signals in accordance with the preference tables 42, display control instruction update routine 44, and preference table update routine 46. These program instructions map each ambient light signal to a user preference value in a user preference table. The user preference value is then converted, in a standard manner, to produce a display control instruction signal that adjusts a parameter on the computer display 24. The user preference values of the preference tables may be established by the hardware preference interface devices 26 or by a graphical user interface appearing on the display 24.

Those skilled in the art will recognize a number of advantages associated with the invention. First, the invention provides for automatic adjustment of computer display parameters in response to ambient light conditions. The automatic adjustments are tailored through reliance upon user preference values. Thus, for example, a user can tailor the computer display parameters so that a linear increase in ambient light conditions results in a corresponding linear increase in the intensity of the computer display. In the alternative, a non-linear relationship can be established by a user and automatically executed by the apparatus 20. The non-linear relationship may be significant when using the multiple color (red, green, and blue) sensors 28 of the invention. In this embodiment, the apparatus 20 is capable of accommodating changes in different color components (red, green, and blue) of the ambient light. This feature provides a user with a great deal of control over computer images appearing on a computer display 24. This control can be favorably employed in desktop publishing. In particular, the user preferences can be set so that an image appearing on the computer display 24 accurately reflects the appearance of the image when it is printed on paper.

Figure 2:
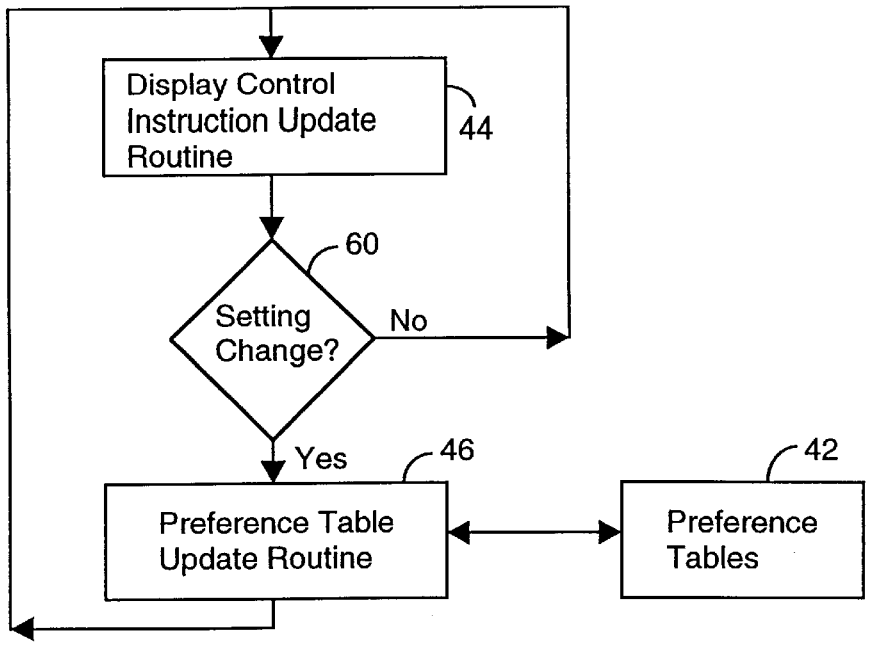
FIG. 2 illustrates a set of operations performed by the apparatus of FIG. 1.

The operation and advantages of the invention will be more fully appreciated in reference to FIGS. 2–5. FIG. 2 illustrates the functional relationship between the program instructions of the invention. In particular, FIG. 2 illustrates that the processor 32 performs a looping operation in which the display control instruction update routine 44 is initially executed. The display control update routine 44 processes the most recent ambient light information from a light sensor 28 and produces changed computer display parameters, if necessary.

Thereafter, a decision block is accessed (block 60) to determine whether there have been any changes to the user preference settings. If not, control returns to the display control instruction update routine 44. If there has been a change in a user preference setting, then control is passed to the preference table update routine 46. As its name implies, the preference table update routine is used to update values in a preference table 42. After the preference values are updated, control returns to the display control instruction update routine 44. Having provided a general outline of the functional operations performed by the invention, attention now turns to a more detailed consideration of each operation.

Figure 3:
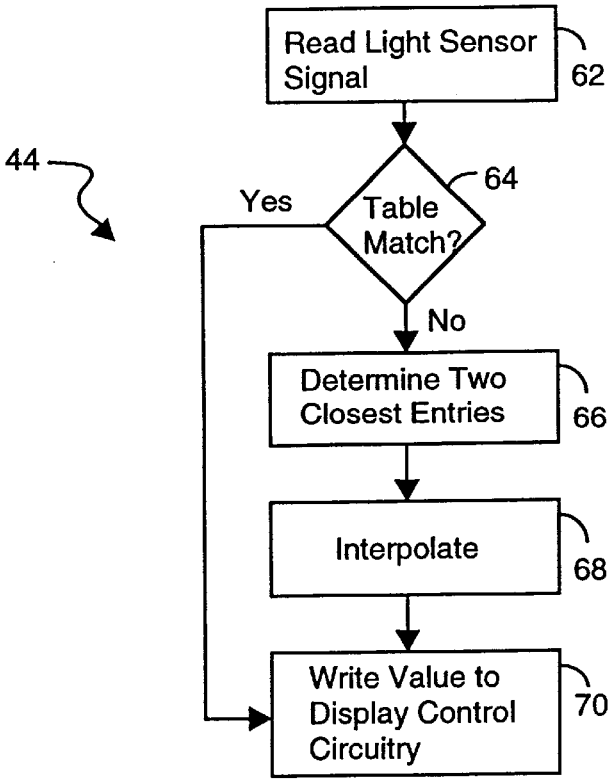
FIG. 3 illustrates a display control instruction update routine that may be used in accordance with the invention.

FIG. 3 illustrates an embodiment of the display control instruction update routine 44 of the invention. The first operation of the routine 44 is to read a light sensor signal (block 62). A determination is then made as to whether the light sensor signal can be directly matched into a user preference table. Below is an example user preference table:

| Table Entry | User Preference Value |
|---|---|
| 0 | 20 |
| 1 | 20 |
| 2 | 40 |
| 3 | 50 |
| 4 | 80 |
| 5 | 90 |

In this example there are N table entries indexed from 0 to N−1. Assume, by way of example, that a light signal intensity value (IV) can have a value between 0 and M, where IV equals 8 and M equals 20. Then it can be seen that the light signal intensity value of 8 maps directly into the a table entry of 2 in the user preference table (Index=IV/M*(N−1)=8/20*5=2).

In this example, there is a table entry match, so control is passed to block 70 where a preference value is written to the display control circuitry 50. That is, the user preference value of 40, corresponding to the table entry of 2, is passed by the processor 32 to the display control circuitry 50 to produce a corresponding display control instruction, which is passed over display control output line 52 to display 24. As a result, the computer display parameter specified by the preference table is modified on the computer display. It should be appreciated that a preference table may exist for a variety of computer display parameters, including brightness, contrast, red light user preferences, green light user preferences, and blue light user preferences.

If the light signal does not result in a direct table entry match into the user preference table, then the two closest preference table entries are identified (block 66). These values may be identified using the following statements:

$$\text{Index_0} = \lfloor IV / M * (N-1) \rfloor \quad \text{(Equation 1)}$$

$$\text{Index_1} = \text{Index_0} + 1 \quad \text{(Equation 2)}$$

By way of example, assume that the light signal (IV) has a value of 7. Then, Index_0=¥7/20 *5⌋=¥1.75⌋=1, and Index_1=1+1=2. Therefore, the two closest preference table entries for a light signal of 7 are table entries 1 and 2.

The next step associated with the operations of FIG. 3 is to interpolate a user preference value (block 68) between these table entries. This operation may be performed using the following statements:

$$\text{Offset} = IV / M * (N-1) - \text{Index_0} \quad \text{(Equation 3)}$$

$$\text{Interpolated Value} = \text{Table[Index_0]} + (\text{Table[Index_1]} - \text{Table[Index_0]}) * \text{Offset} \quad \text{(Equation 4)}$$

Still relying upon a light signal value of 7, it can be seen that the Offset=7/20*(5)−1=1.75−1=0.75. It can also be seen that the Interpolated Value =20+(40−20)*0.75=35. Thus, the light signal value of 7 maps to a user preference value of 35, which is written to the display control circuitry (block 70).

The display control instruction update routine 44 has now been described. As indicated in FIG. 2, after this routine has been run, a determination is made as to whether there has been a setting change (decision block 60). The processor 32 identifies any setting change requests. If one exists, the preference table update routine 46 is called. One embodiment of the preference table update routine 46 is illustrated in FIG. 4.

Figure 4:
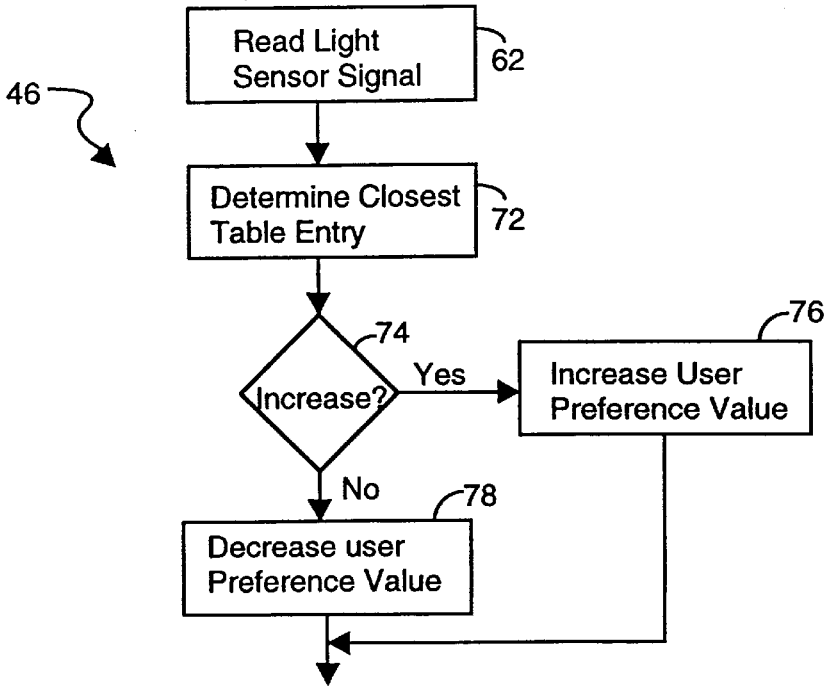
FIG. 4 illustrates a preference table update routine that may be used in accordance with the invention.

The first operation performed by the routine 46 of FIG. 4 is to read the light sensor signal (block 62). Next, the closest preference table entry is identified (block 72). This can be accomplished using the following equation:

$$\text{Index} = \lfloor IV / M * (N-1) + 0.5 \rfloor. \quad \text{(Equation 5)}$$

After the closest table entry value is identified using equation 5, a determination is made whether an increase in a value has been selected (decision block 74). For example, the processor 32 will monitor whether a brightness increase key of the hardware preference interface devices 26 has been pushed, and if so, how many times.

If an increase in a user preference value is selected, the user preference value corresponding to the closest table entry is increased (block 76) by some predetermined value for each requested increase. If a decrease in value has been selected, the user preference value corresponding to the closest table entry is decreased (block 78). These preference values may be permanently stored in an EEPROM. An original set of default preference values are preferably provided.

After preference values have been modified, control returns to the control instruction update routine 44. The control instruction update routine 44 will thereby force the new user preference value to be reflected on the display screen 24.

Figure 5:
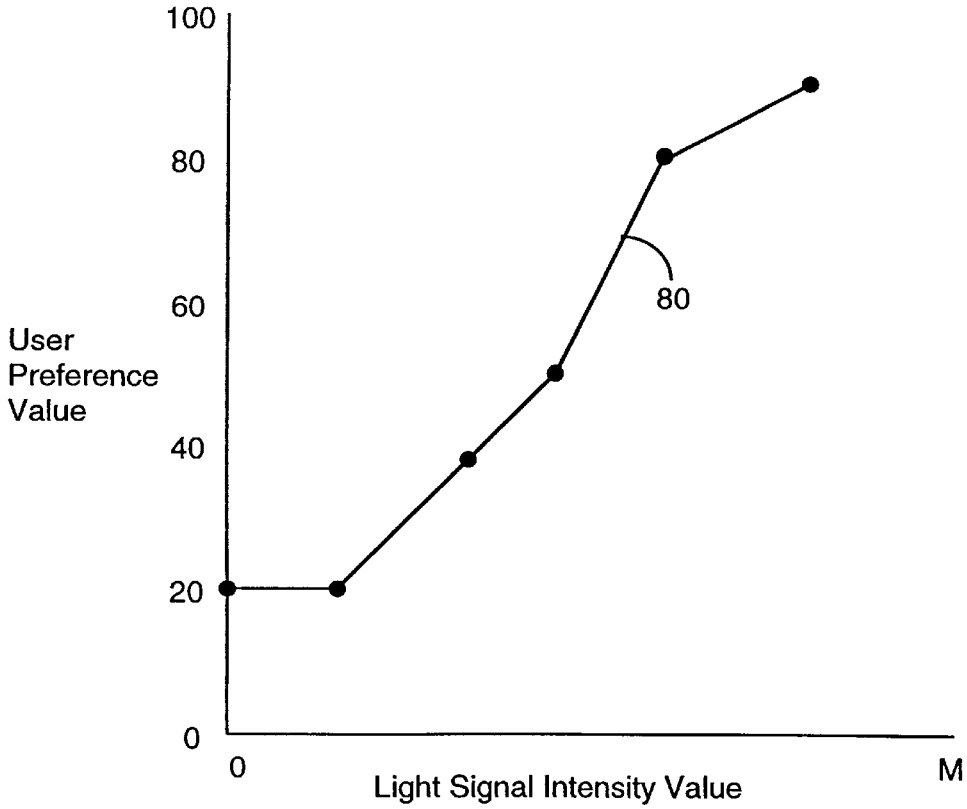
FIG. 5 illustrates an exemplary graphical user preference table that may be used and modified in accordance with the invention.

FIG. 5 is a graphical representation of user preference values as a function of light signal intensity values (V). This example corresponds to the preference table provided above. Using standard programming techniques, a graphical interface 47 may be created to present a curve 80 on the display 24. Standard programming techniques can also be used to allow a user to manipulate the shape of the curve 80, for instance by using a mouse to click onto a portion of the curve and then moving the portion of the curve as desired. Such a graphical interface may be preferable in some applications to the use of hardware preference interface devices 26. A graphical interface of this type provides a smoothing function between neighboring user preference values.

As previously indicated, a variety of user preference tables may be used in accordance with the invention. The use of a red light user preference table, a green light user preference table, and a blue light user preference table is particularly advantageous in the field of desktop publishing. In this context, the user can tailor each color preference table so that the computer display more accurately reflects the image that will actually appear on paper.

The use of the invention's preference tables for brightness and contrast features provides a computer user with a computer display that is highly optimized for an individual's preferences. These individual preferences can be used to make the screen appear the same, regardless of the ambient light, or to provide different visual effects dependent upon the ambient light.

The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. An apparatus to automatically adjust computer display parameters of a computer display in response to ambient light conditions, comprising:

an ambient light sensor to obtain an ambient light signal;

a mapping mechanism connected to said ambient light sensor to select, using only said ambient light signal, a plurality of user-specified preference values in a corresponding plurality of user preference tables which establish user-specified preference settings for a range of light conditions;

a preference table alteration mechanism to store and change selected user-specified preference values within said plurality of user preference tables, said preference table alteration mechanism changing said selected user-specified preference values only when said user-specified preference settings are changed by a user; and computer display control circuitry connected to said mapping mechanism to adjust said computer display parameters of said computer display in response to said user-specified preference values.

2. The apparatus of claim 1 wherein said mapping mechanism includes a computer processor operating with a computer readable memory which stores said plurality of user preference tables.

3. The apparatus of claim 2 wherein said computer processor executes program instructions stored in said computer readable memory, said program instructions including a first set of instructions to convert said ambient light signal into a corresponding table entry signal within said plurality of user preference tables.

4. The apparatus of claim 3 wherein said program instructions further include a second set of instructions to correlate said table entry signal with said plurality of user-specified preference values within said corresponding plurality of user preference tables.

5. The apparatus of claim 1 wherein said ambient light sensor is a light intensity sensor.

6. The apparatus of claim 5 wherein one of said plurality of user preference tables stores user preference light intensity values.

7. The apparatus of claim 5 wherein one of said plurality of user preference tables stores light contrast values.

8. The apparatus of claim 1 wherein said ambient light sensor includes a red light sensor to produce a red ambient light signal, a green light sensor to produce a green ambient light signal, and a blue light sensor to produce a blue ambient light signal.

9. The apparatus of claim 8 wherein said plurality of user preference tables includes a red light user preference table, a green light user preference table, and a blue light user preference table.

10. The apparatus of claim 9 wherein said mapping mechanism maps said red ambient light signal to a red user preference value in said red light user preference table, said green ambient light signal to a green user preference value in said green light user preference table, and said blue ambient light signal to a blue user preference value in said blue light user preference table, said red user preference value, said green user preference value, and said blue user preference value being used to respectively adjust red, green, and blue computer display parameters of said computer display.

11. The apparatus of claim 1 wherein said preference table alteration mechanism is a hardware preference interface device.

12. The apparatus of claim 1 wherein said preference table alteration mechanism is a software graphical interface appearing on said computer display.

13. The apparatus of claim 1 wherein said computer display is a liquid crystal display screen.

14. A method of constructing an apparatus to automatically adjust computer display parameters of a computer display in response to ambient light conditions, said method comprising the steps of;

providing an ambient light sensor to obtain an ambient light signal;

providing a mapping mechanism connected to said ambient light sensor to select, using only said ambient light signal, a plurality of user-specified preference values in a corresponding plurality of user preference tables which establish user-specified preference settings for a range of light conditions;

providing a preference table alteration mechanism to store and change selected user-specified preference values within said plurality of user preference tables, said preference table alteration mechanism changing said selected user-specified preference values only when said user-specified preference settings are changed by a user; and providing computer display control circuitry connected to said mapping mechanism to adjust said computer display parameters of said computer display in response to said user-specified preference values.

15. The method of claim 14 further comprising the step of providing an ambient light sensor including a red light sensor to produce a red ambient light signal, a green light sensor to produce a green ambient light signal, and a blue light sensor to produce a blue ambient light signal.

16. The method of claim 15 further comprising the step of providing a plurality of user preference tables including a red light user preference table, a green light user preference table, and a blue light user preference table.

17. A method of automatically adjusting computer display parameters of a computer display in response to ambient light conditions, said method comprising the steps of:

sensing an ambient light signal;

mapping said ambient light signal to a plurality of user-specified preference values in a corresponding plurality of user preference tables which establish user-specified preference settings for a range of light conditions;

changing selected user-specified preference values within said plurality of user preference tables only when said user-specified preference settings are changed by a user; and adjusting said computer display parameters of said computer display in response to said user-specified preference values.

18. The method of claim 17 wherein said mapping step includes the step of converting said ambient light signal into a corresponding table entry signal within said plurality of user preference tables.

19. The method of claim 18 wherein said mapping step includes the step of correlating said table entry signal with said plurality of user-specified preference values within said corresponding plurality of user preference tables.

20. The method of claim 17 wherein said sensing step includes the steps of sensing a red ambient light signal, a green ambient light signal, and a blue ambient light signal.

21. The method of claim 20 wherein said mapping step includes the steps of mapping said red ambient light signal to a red user preference value in a red light user preference table;

mapping said green ambient light signal to a green user preference value in a green light user preference table; and mapping a blue ambient light signal to a blue user preference value in a blue light user preference table, so as to adjust red, green, and blue computer display parameters of said computer display.

* * * * *